US011083656B2

(12) United States Patent
Yen et al.

(10) Patent No.: US 11,083,656 B2
(45) Date of Patent: Aug. 10, 2021

(54) MATTRESS STRUCTURE

(71) Applicant: Brilliant Product Design Co., Ltd., Taipei (TW)

(72) Inventors: Ying-Chun Yen, Taipei (TW); Yuan-Chen Chen, Taipei (TW)

(73) Assignee: Brilliant Product Design Co., Ltd., Taipei (TW)

( * ) Notice: Subject to any disclaimer, the term of this patent is extended or adjusted under 35 U.S.C. 154(b) by 230 days.

(21) Appl. No.: 16/401,116

(22) Filed: May 2, 2019

(65) Prior Publication Data

US 2019/0336370 A1 Nov. 7, 2019

Related U.S. Application Data

(60) Provisional application No. 62/666,058, filed on May 2, 2018.

(51) Int. Cl.

| | |
|---|---|
| ***A61G 7/057*** | (2006.01) |
| ***A61G 7/10*** | (2006.01) |
| ***A61G 7/00*** | (2006.01) |

(52) U.S. Cl.

CPC ..... *A61G 7/05769* (2013.01); *A61G 7/001* (2013.01); *A61G 7/1021* (2013.01); *A61G 2200/32* (2013.01)

(58) Field of Classification Search

CPC .. A61G 7/05769; A61G 7/1021; A61G 7/001; A61G 7/1026; A61G 7/05776; A61G 2200/32; A47C 27/10

See application file for complete search history.

(56) References Cited

U.S. PATENT DOCUMENTS

| | | | | |
|---|---|---|---|---|
| 1,901,858 | A * | 3/1933 | Fischer | B65D 33/12 493/220 |
| 2002/0133877 | A1* | 9/2002 | Kuiper | A61G 7/001 5/81.1 R |
| 2006/0117490 | A1 | 6/2006 | Hung et al. | |
| 2006/0218728 | A1 | 10/2006 | Liu | |

(Continued)

FOREIGN PATENT DOCUMENTS

| | | |
|---|---|---|
| CN | 201045986 | 4/2008 |
| CN | 201139718 | 10/2008 |

(Continued)

OTHER PUBLICATIONS

"Office Action of China Counterpart Application", dated Dec. 30, 2020, pp. 1-9.

*Primary Examiner* — Eric J Kurilla
*Assistant Examiner* — James T Coble
(74) *Attorney, Agent, or Firm* — JCIPRNET

(57) ABSTRACT

A mattress structure including a base, an air bag structure and a fluid driving device is provided. The air bag structure is disposed on the base. The air bag structure includes a plurality of independent sub air bag structures. A plurality of supporting structures are disposed in each of the sub air bag structures. The fluid driving device is connected to the sub air bag structures so as so inject fluid to the sub air bag structures selectively. When the fluid driving device injects the fluid to at least one of the sub air bag structures so as to make the at least one of the sub air bag structures expand, each of the supporting structure is connected to two opposite surfaces of the expanded sub air bag structure.

12 Claims, 8 Drawing Sheets

(56) References Cited

U.S. PATENT DOCUMENTS

| | | | | |
|---|---|---|---|---|
| 2008/0263763 | A1* | 10/2008 | Butler | A61G 7/05715 5/81.1 R |
| 2017/0196368 | A1* | 7/2017 | Liu | A47C 27/16 |

FOREIGN PATENT DOCUMENTS

| | | |
|---|---|---|
| CN | 202198198 | 4/2012 |
| CN | 202681275 | 1/2013 |
| CN | 106821581 | 6/2017 |
| CN | 107303099 | 10/2017 |
| TW | M375500 | 3/2010 |
| TW | M537896 | 3/2017 |
| TW | I608835 | 12/2017 |
| TW | 201817408 | 5/2018 |

* cited by examiner

MATTRESS STRUCTURE

CROSS-REFERENCE TO RELATED APPLICATION

This application claims the priority benefit of U.S. provisional application Ser. No. 62/666,058, filed on May 2, 2018. The entirety of the above-mentioned patent application is hereby incorporated by reference herein and made a part of this specification.

BACKGROUND

Technical Field

The disclosure relates to a mattress structure, and more particularly relates to a mattress structure having an air bag structure.

Description of Related Art

For a patient who is on chronic bedrest and cannot turn over by him/herself, long-term pressure applies to parts of the body may result in obstructed blood flow and thereby causes ischemia and localized damage to the skin, bedsores are thereby generated easily. Bedsores may lead to infection, so the patient has to be regularly turned over to change his/her postures with the assistance of a medical professional.

Nevertheless, if the patient is relatively heavy or the patient is required to be maintained in a specific position, several medical professionals are required to work together to turn the patient over, significant time and efforts are thereby consumed. Further, the medical professionals may experience arm and waist injuries after a while, so assisting patients in changing postures may become a burden for medical professionals when working. Therefore, development of a mattress configured to assist a patient in adjusting postures (e.g., turning over) is therefore an urgent issue.

SUMMARY

The disclosure provides a mattress structure capable of adjusting a posture of a patient and exhibiting favorable structural stability.

An embodiment of the disclosure provides a mattress structure including a base, an air bag structure, and a fluid driving device. The air bag structure is disposed on the base. The air bag structure includes a plurality of independent sub air bag structures. A plurality of supporting structures are disposed in each of the sub air bag structures. The fluid driving device is connected to the sub air bag structures so as to inject fluid into the sub air bag structures selectively. When the fluid driving device injects the fluid into at least one of the sub air bag structures so as to make at least one of the sub air bag structures expand, in the corresponding expanded sub air bag structure, each of the supporting structures is connected to two opposite surfaces of the expanded sub air bag structure.

In an embodiment of the disclosure, when the sub air bag structure expands, the sub air bag structure exhibits a triangular prism-like structure. The triangular prism-like structure has a bottom surface and two side surfaces connected to the bottom surface. The supporting structures include a first supporting structure and a plurality of second supporting structures. The first supporting structure is connected to the two side surfaces, parts of the second supporting structures are connected to one of the two side surfaces and the bottom surface, and other parts of the second supporting structures are connected to the other one of the two side surfaces and the bottom surface.

In an embodiment of the disclosure, a width of the triangular prism-like structure gradually decreases from one side adjacent to the base towards the other side of away from the base.

In an embodiment of the disclosure, an included angle between an extended surface of the bottom surface of the triangular prism-like structure and an extended surface of anyone of the two side surfaces is less than or equal to 45 degrees.

In an embodiment of the disclosure, the sub air bag structures include a first sub air bag structure and a second sub air bag structure. The fluid driving device injects fluid to or extracts fluid from the first sub air bag structure and the second sub air bag structure selectively, so that a thickness difference is provided between the first sub air bag structure and the second sub air bag structure.

In an embodiment of the disclosure, a structure of the base is a rectangular structure, and the first sub air bag structure and the second sub air bag structure are disposed along long sides of the rectangular structure.

In an embodiment of the disclosure, the base further includes a first control valve. The fluid driving device is connected to the base through the first control valve, so as to selectively inject fluid into the base or extract fluid from the base.

In an embodiment of the disclosure, the base further includes a second control valve different from the first control valve. The first control valve is a bidirectional control valve, and the second control valve is a unidirectional control valve.

In an embodiment of the disclosure, each of the sub air bag structures further includes a third control valve. The fluid driving device is connected to the sub air bag structures through the third control valves.

In an embodiment of the disclosure, each of the sub air bag structures further comprises a fourth control valve different from the third control valve. The third control valve is a bidirectional control valve, and the fourth control valve is a unidirectional control valve.

In an embodiment of the disclosure, the mattress structure further includes a plurality of first bonding structures, a plurality of second bonding structures, and a mattress body structure. The first bonding structures are disposed on top surfaces of the sub air bag structures. The second bonding structures are disposed on a bottom surface of the mattress body structure. The mattress body structure provides bonding through the first bonding structures and the second bonding structures, so that the mattress body structure is detachably bonded to the air bag structure.

In an embodiment of the disclosure, the mattress structure further includes a plurality of handle pairs. Each of the handle pairs further includes two handle loops. The handle pairs penetrate the base so that the handle loops are exposed.

In an embodiment of the disclosure, patch structures are disposed at junctions between the handle loops and the base.

In view of the above, in the mattress structure provided by the embodiments of the disclosure, fluid is selectively injected into the corresponding sub air bag structure through the fluid driving device, so the corresponding sub air bag structure expands, and that the posture of the patient lying thereon may be quickly adjusted through the expanded sub air bag structure, and burden of the medical professional is thereby reduced. Next, when the sub air bag structure expands owing to fluid injection, the supporting structures may effectively provide a shape fixing force to resist the outward pressure applied to the sub air bag structure by the fluid, so that the sub air bag structure expands in a certain shape and is not excessively deformed. Therefore, the mattress structure provided by the disclosure exhibits favorable structural stability.

To make the aforementioned more comprehensible, several embodiments accompanied with drawings are described in detail as follows.

DESCRIPTION OF THE EMBODIMENTS

Figure 1A:
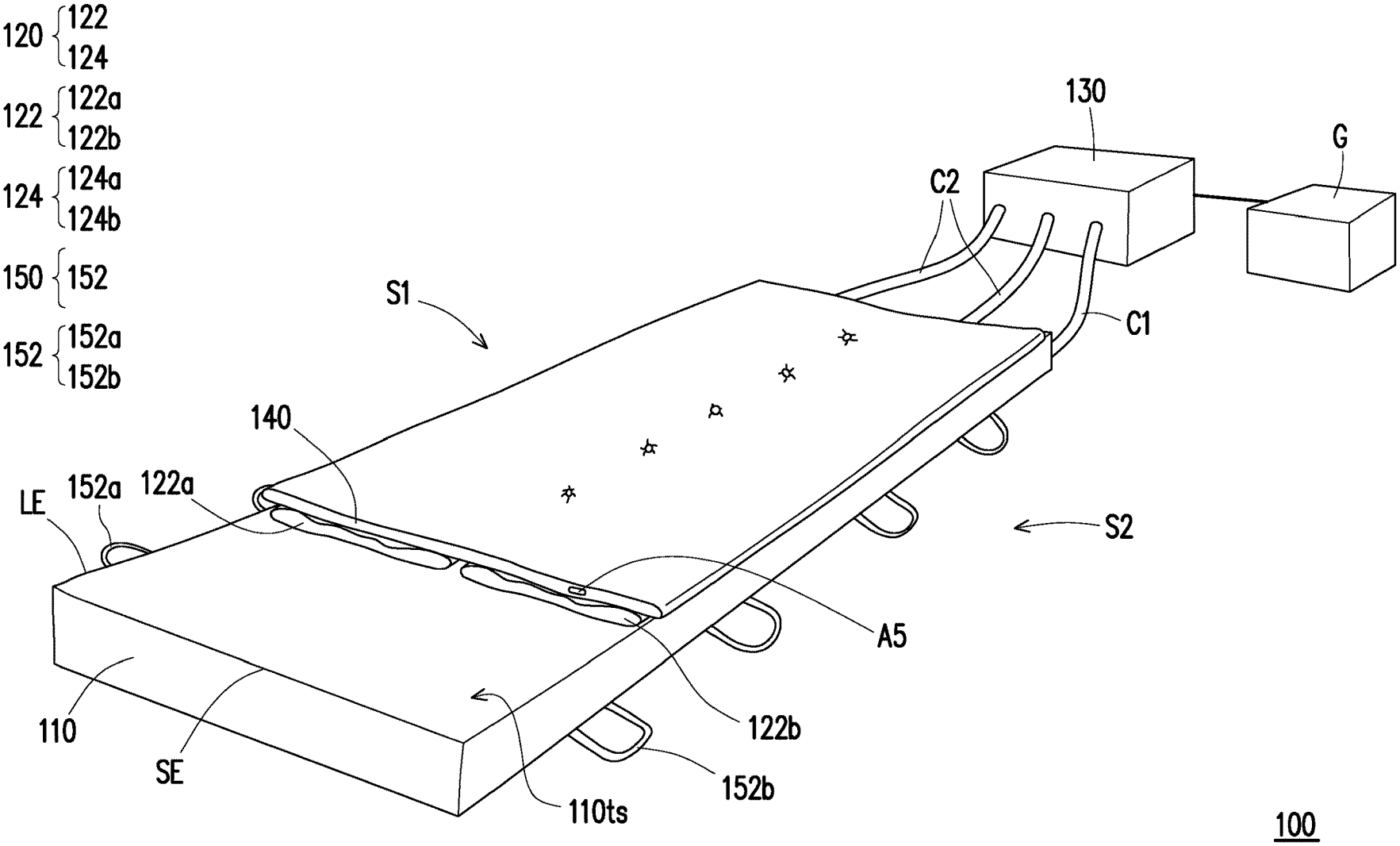
FIG. 1A is a schematic oblique view of a mattress structure when an air bag structure thereof does not expand according to an embodiment of the disclosure.
Figure 1B:
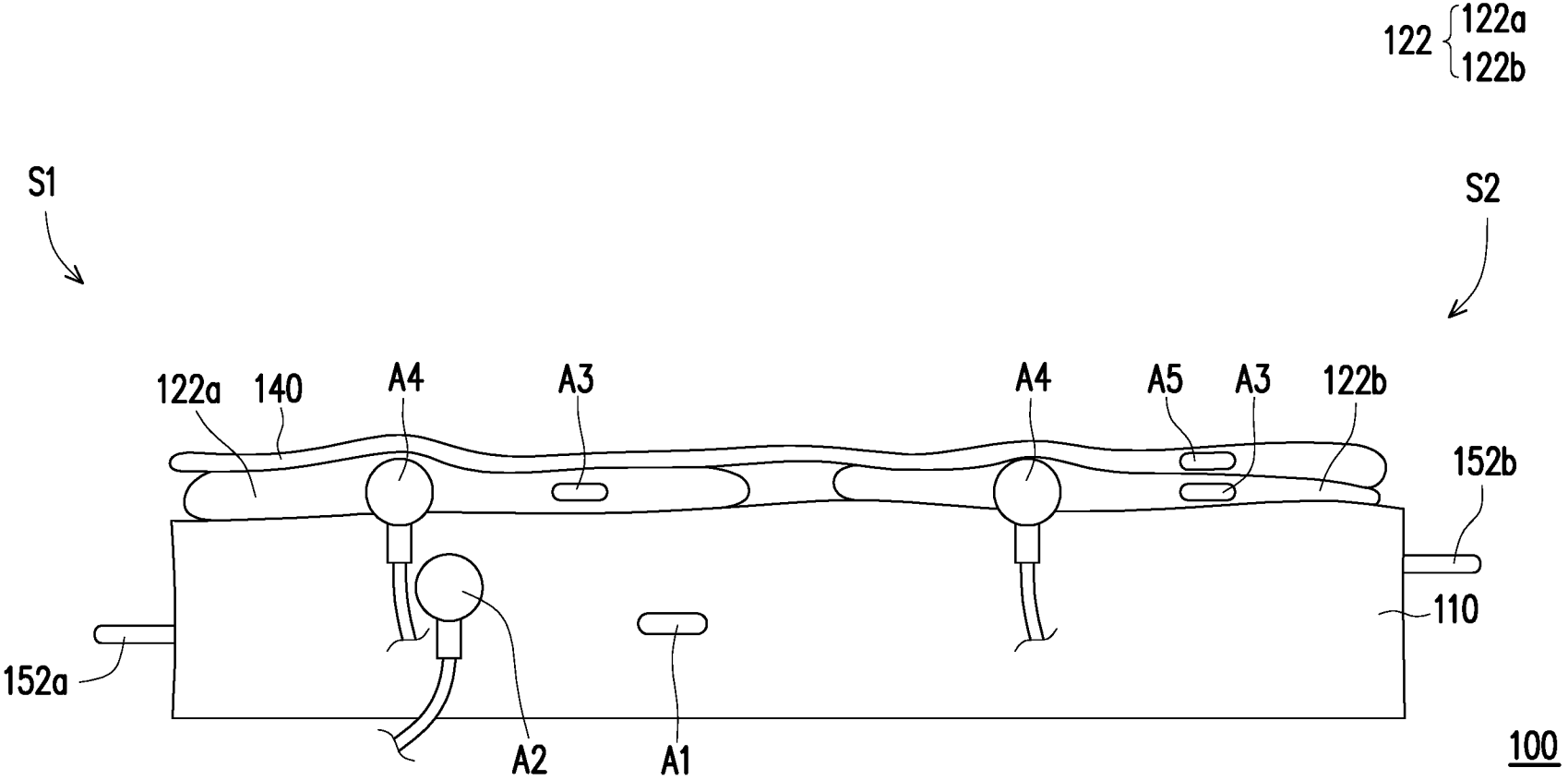
FIG. 1B is a schematic side view of FIG. 1A.
Figure 2A:
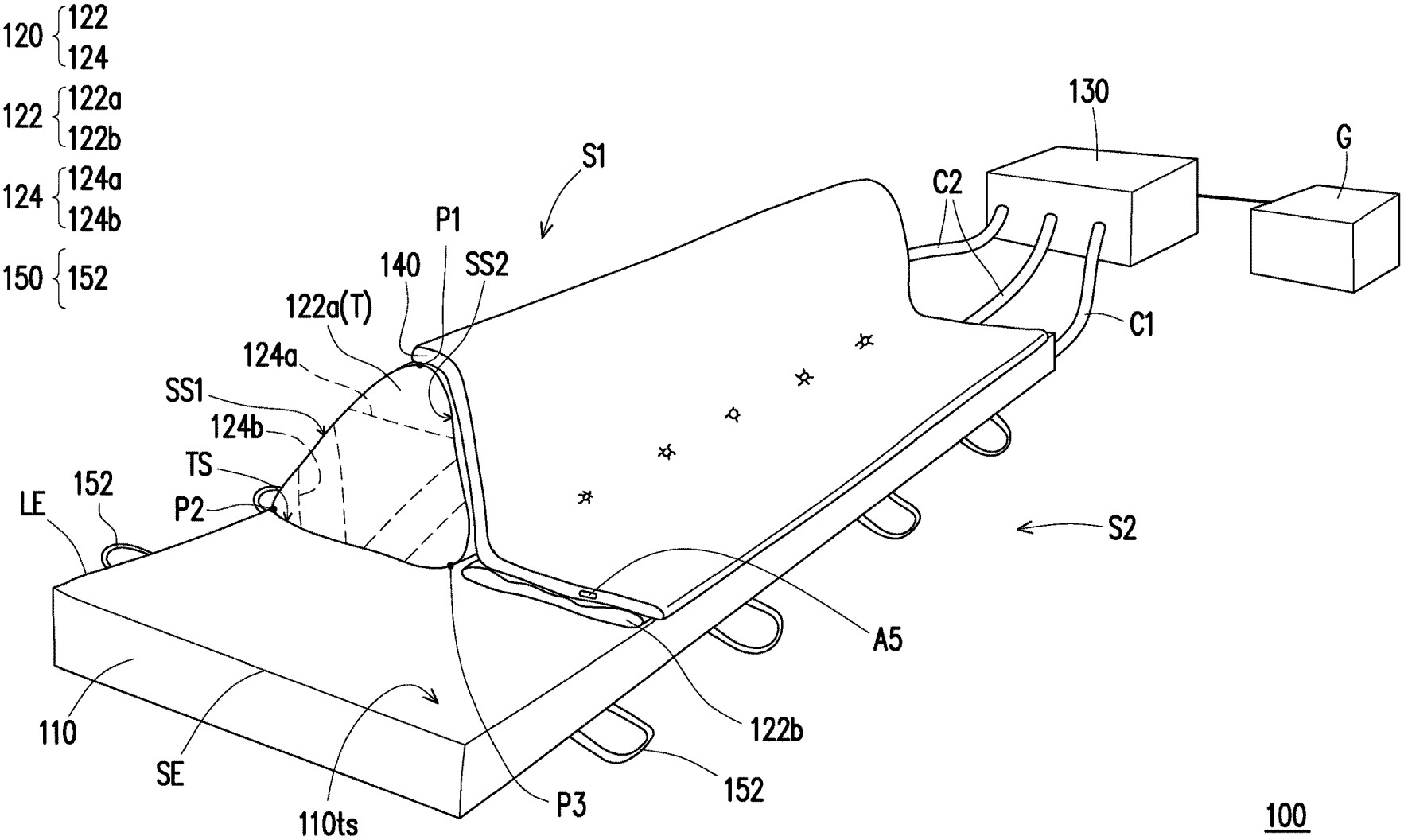
FIG. 2A is a schematic oblique view of injecting fluid to one sub air bag structure and not injecting fluid to another sub air bag structure by a fluid driving device in FIG. 1A.
Figure 2B:
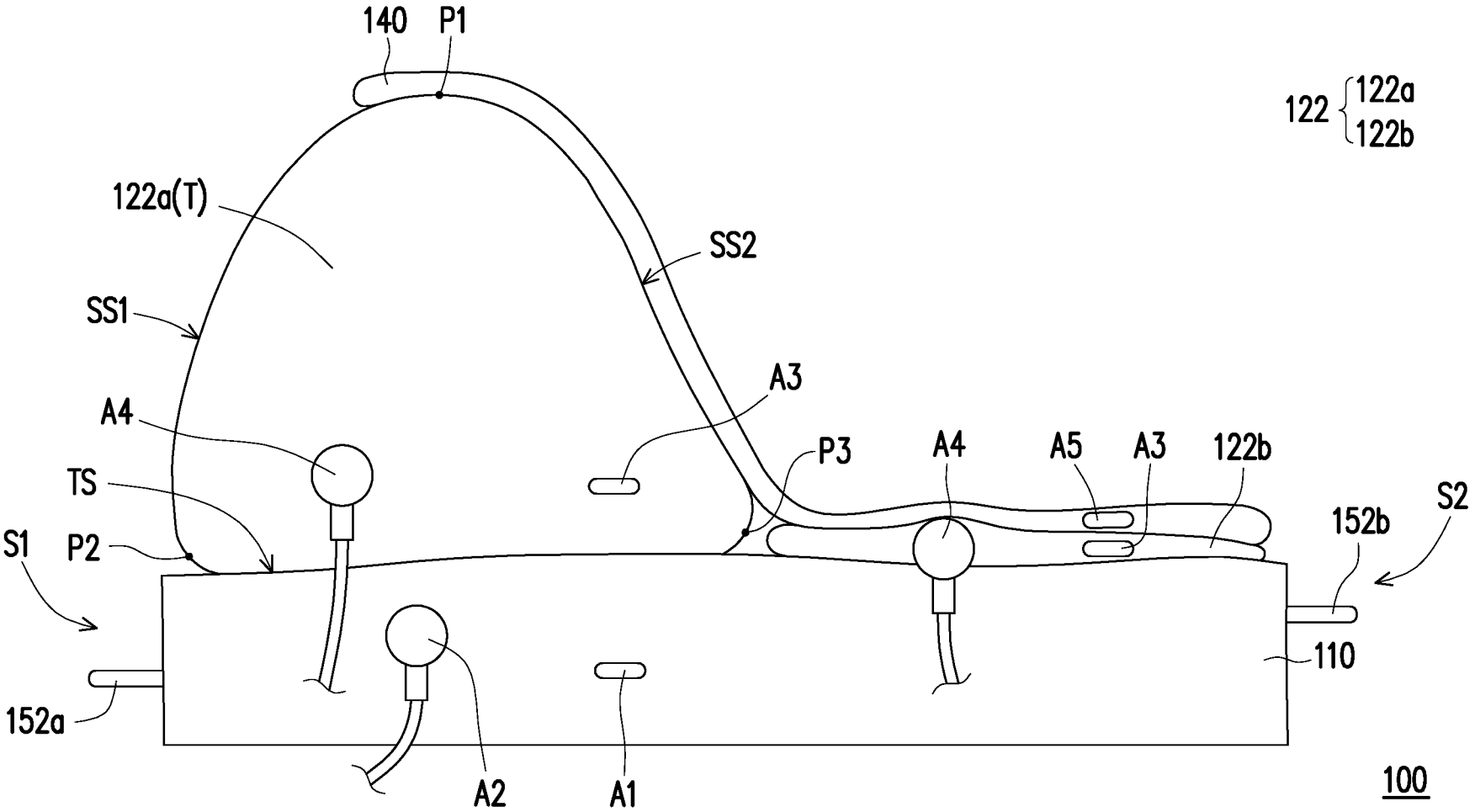
FIG. 2B is a schematic side view of FIG. 2A.
Figure 3:
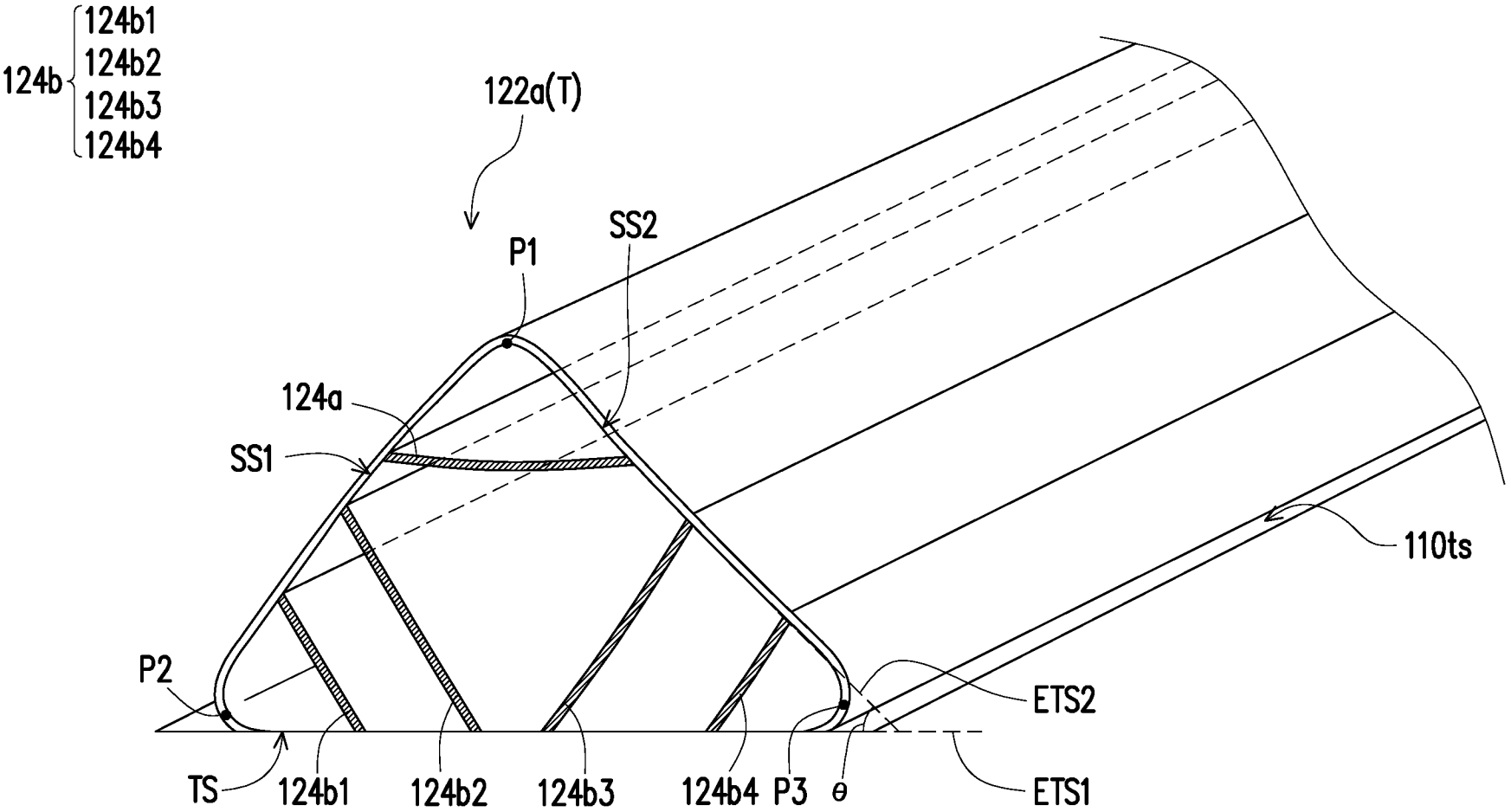
FIG. 3 is a schematic enlarged view of an expanded first sub air bag structure.

FIG. 1A is a schematic oblique view of a mattress structure when an air bag structure thereof does not expand according to an embodiment of the disclosure. FIG. 1B is a schematic side view of FIG. 1A. FIG. 2A is a schematic oblique view of injecting fluid to one sub air bag structure and not injecting fluid to another sub air bag structure by a fluid driving device in FIG. 1A. FIG. 2B is a schematic side view of FIG. 2A. FIG. 3 is a schematic enlarged view of an expanded first sub air bag structure.

With reference to FIG. 1A, FIG. 1B, FIG. 2A, FIG. 2B, and FIG. 3, in this embodiment, a mattress structure 100 includes a base 110, an air bag structure 120, a fluid driving device 130, a mattress body structure 140, and a controller G. Arrangement and connection relations among the foregoing devices are described in detail in the following paragraphs.

In this embodiment, the base 110 is elastic (or deformable) and may expand or contract as fluid may be injected into or extracted from the base 110. The base 110 includes two different control valves A1 and A2. The control valve A1 of the base 110 is connected to the fluid driving device 130 through a transportation pipeline C1. The control valve A2 is not connected to the fluid driving device 130. When the control valve A2 is turned off, an internal of the base 110 is isolated from the outside so that fluid inside the base 110 is prevented from being flowing out. When the control valve A2 is turned on, connection to the outside is available, so that the fluid inside the base 110 may be quickly discharged from the base 110. The base 110 roughly exhibits as a rectangular structure, for example, and has two long sides LE and two short sides SE. In this embodiment, the fluid may be gas. The base 110 may be an inflatable airbed or a latex mattress. In other embodiments, the fluid may be liquid. Liquid may be correspondingly injected into the base 110.

In this embodiment, the air bag structure 120 is disposed on the base 110 and includes a plurality of independent sub air bag structures 122. The air bag structure 120 is also made of an elastic (or deformable) material. The sub air bag structures 122 include a first sub air bag structure 122*a* and a second sub air bag structure 122*b*. The first and the second sub air bag structures 122*a* and 122*b* are disposed along the long sides LE of the base 110. As shown in FIG. 2A or FIG. 3, a plurality of supporting structures 124 are disposed in each of sub air bag structures 122, and the sub air bag structures 124 are connected to the sub air bag structures 122 through, for example, a welding manner and thus are less susceptible to damage, so that durability of the product is enhanced. The supporting structures 124 are elements supporting a shape of the supporting structures 122 during fluid injection and are, for examples, beams. Each of the sub air bag structures 122 has different control valves A3 and A4. The control valves A3 are connected to the fluid driving device 130 through a transportation pipeline C2. The control valves A4 are not connected to the fluid driving device 130. When the control valves A4 are turned off, internal parts of the sub air bag structures 122 are isolated from the outside, so that fluid inside the sub air bag structures 122 is prevented from being flowing out. When the control valve A4 is turned on, connection to the outside is available, so that the fluid inside the sub air bag structures 122 may be quickly discharged from the sub air bag structures 122. Gas or liquid may be injected into the air bag structure 120. In this embodiment, preferably, gas is used to be injected into the air bag structure 120. In other embodiments, liquid may be injected into the air bag structure 120, and which should not be construed as limitations to the disclosure.

In this embodiment, the fluid driving device 130 is a device used to move fluid, that is, a mechanical device which does work on the fluid, such as a fluid pump. The fluid driving device 130 may control bidirectional flowing of fluid in the base 110 and the air bag structure 120 (e.g., the first and the second sub air bag structures 122*a* and 122*b*) through the transportation pipelines C1 and C2 and the control valves A1 and A3, and the control valve A2 and A4 are configured to unidirectionally discharge the fluid inside the base 110 and the air bag structure 120. In other words, the control valves A1 and A3 are bidirectional control valves, and the control valves A2 and A4 are unidirectional control valves.

In this embodiment, the mattress body structure 140 is, for example, an elastic foam mattress, but is not limited thereto. The mattress body structure 140 includes a control valve A5 and may be connected to the fluid driving device 130. The fluid driving device 130 may inject fluid into the mattress body structure 140 or extract fluid from the mattress body structure 140 through the control valve A5. When storage is required to be performed, the fluid driving device 130 may extract the fluid inside the mattress body structure 140, so that volume of the mattress body structure 140 is reduced, and storage may thereby be conveniently performed. When in use, the fluid driving device 130 may inject fluid into the mattress body structure 140, so that the mattress body structure 140 expands to be used.

In this embodiment, the controller G is electrically coupled to the fluid driving device 130 and is configured to send a control signal to control the fluid driving device 130 to inject fluid into or extract fluid from a selected sub air bag structure 122 or to perform no action. The controller G includes an input interface (not shown), a health professional or a patient may input a control command to the controller G through the input interface. The input interface is, for example, a keyboard or a touch screen, and which should not be construed as limitations to the disclosure.

Functions of the mattress structure 100 of this embodiment are described in detail in the following paragraphs.

With reference to FIG. 1A and FIG. 1B, when the sub air bag structures 122*a* and 122*b* do not expand, the sub air bag structures 122*a* and 122*b* are roughly flat-shaped. A patient may lie flat on the mattress body structure 140.

With reference to FIG. 2A and FIG. 2B, when the fluid driving device 130 is controlled by the controller G to inject fluid into the first sub air bag structure 122*a* and not to inject fluid into the second sub air bag structure 122*b*, the first sub air bag structure 122*a* expands and expands into a triangular prism-like structure T owing to injection of the fluid, and the second sub air bag structure 122*b* does not expand and is still flat-shaped, so that a thickness difference is provided therebetween, and such thickness difference enables the patient lying thereon to turn over. That is, the fluid driving device 130 is controlled by the controller G and generates a thickness distribution corresponding to different regions on the base 110 through the air bag structure 120. The controller G may control the fluid driving device 130 to control an amount of fluid to be injected into or to be extracted from the sub air bag structures 122, so as to control an angle at which the patient turns over. The triangular prism-like structure T may be regarded as a backrest. In the mattress structure 100, the mattress body structure 140, the expanded second sub air bag structure 122*a*, and the base 100 form a three-layer structure featuring an appealing appearance.

With reference to FIG. 2A and FIG. 3, in the corresponding expanded first sub air bag structure 122*a*, each of the supporting structures 124 is connected to two opposite surfaces of the sub air bag structure 122*a*. Specifically, the first sub air bag structure 122*a* exhibiting the triangular prism-like structure T has a bottom surface TS and two side surfaces SS1 and SS2 connected to the bottom surface TS. A width of the triangular prism-like structure T gradually decreases from one side adjacent to the base 110 towards the other side of away from the base 110. That is, the width of the triangular prism-like structure T is greater near the bottom and narrower near the top. The supporting structures 124 include a first supporting structure 124*a* and a plurality of second supporting structures 124*b*. The first supporting structure 124*a* is connected to the two side surfaces SS1 and SS2. Parts of the second supporting structures 124*b* such as 124*b*1 and 124*b*2 are connected to one side surface SS1 of the two side surfaces SS1 and SS2 and the bottom surface TS, and other parts of the second supporting structures 124*b* such as 124*b*3 and 124*b*4 are connected to the other side surface SS2 of the two side surfaces SS1 and SS2 and the bottom surface TS.

In the expanded first sub air bag structure 122*a*, the first supporting structure 124*a* is roughly horizontally-shaped and is substantially parallel to a top surface 110*ts* of the base 110. The second supporting structures 124*b* are roughly inclined with respect to the first supporting structure 124*a*. The first supporting structure 124*a* may thereby be treated as a horizontal supporting structure, and the second supporting structures 124*b* may be treated as inclined supporting structures. In this embodiment, a number of the first supporting structure 124*a* is, for example, one, and a number of the second supporting structures 124*b* is, for example, four, and the numbers of the first and the second supporting structures 124*a* and 124*b* may be designed by people having ordinary skill in the art according to needs, and which should not be construed as limitations to the disclosure.

When fluid is injected into the first sub air bag structure 122*a*, the fluid applies an outward pressure to the bottom surface TS and the two side surfaces SS1 and SS2. The horizontal first supporting structure 124*a* may provide an inward reactive pulling force, so that the two side surfaces SS1 and SS2 may resist the outward pressure of the fluid, and the triangular prism-like structure T of the first sub air bag structure 122*a* is thereby maintained. Similarly, the inclined second supporting structures 124*b* may provide a reactive pulling force to the bottom surface TS and the two sides SS1 and SS2 of the first sub air bag structure 122*a*. That is, the inclined second supporting structures 124*b* provide the bottom surface TS with an oblique upward pulling force, so that the bottom surface TS is prevented from being excessively deformed when downwardly expanding and being curved owing to fluid injection. In other words, the inclined second supporting structures 124*b* provides the bottom surface TS with a pulling force to resist the outward pressure of the fluid, so that the bottom surface TS is maintained to be flat. Since the bottom surface TS is maintained to be flat instead of being downwardly curved and raised, a contact area between the first sub air bag structure 122*a* and the base 110 is relatively large, and stability and an appealing appearance are thereby provided. The inclined second supporting structures 124*b* may also provide the two side surfaces SS1 and SS2 with a reactive oblique downward pulling force. In short, when expanding, the sub air bag structures 122 may expand in a certain shape and are not excessively deformed owing to the sub air bag structures 124, and the mattress structure 100 thereby features a favorable structural stability.

Herein, it should be noted that: bonding lines (not shown) are disposed on the first and the second sub air bag structures 122*a* and 122*b* at three different positions P1, P2, and P3, and any of the sub air bag structures 122*a* and 122*b* expand, the bonding lines provide surfaces located at two sides corresponding to the bonding lines with a shape fixing force, so that the sub air bag structure 122 is shaped as the triangular prism-like structure T. In addition, the expanded first sub air bag structure 122*a* is not necessary a perfect triangular prism structure, and in most cases, round corners are provided at the positions P1, P2, and P3 where the bonding lines are disposed, so that the triangular prism-like structure T is exhibited. The triangular prism-like structure T satisfies the following conditions: it is assumed that three different imaginary tangent planes respectively pass through any point on each of the side surface SS1, the side surface SS2, and the bottom surface TS, the three different imaginary tangent planes are extended, the points of intersection where two of the planes intersect may form a triangle, and a structure formed by connection of the side surfaces SS1 and SS2 and the bottom surface TS is the triangular prism-like structure T.

In this embodiment, the fluid driving device 130 injects fluid into the first sub air bag structure 122*a* and does not perform any action to the second sub air bag structure 122*b*. In other embodiments, the fluid driving device 130 may not perform any action to the first sub air bag structure 122*a* and injects fluid into the second sub air bag structure 122*b*. Alternatively, the fluid driving device 130 may inject fluid into both the first sub air bag structure 122*a* and the second sub air bag structure 122*b*, and an amount of the fluid injected by the fluid driving device 130 into the two sub air bag structures 122*a* and 122*b* may be controlled by the controller G. The disclosure is not intended to limit flowing directions of the fluid as long as the thickness difference (or the thickness distribution) is generated therebetween.

In this embodiment, the air bag structure 120 includes, for example, the first sub air bag structure 122*a* and the second sub air bag structure 122*b* disposed along the long sides LE of the base 110, and the effect of turning the patient over may be achieved through the foregoing operation manner. With reference to FIG. 3 again, an included angle θ is provided between an extended surface ETS1 of the bottom surface TS and an extended surface ETS2 of anyone of the two side surfaces SS1 and SS2. When a maximum value of the included angle θ is less than or equal to 45 degrees, a medical professional may conveniently turn a patient over or adjust a posture of the patient, and the patient is also considerably prevented from being injured when being turned.

In other embodiments, the first sub air bag structure 122*a* and the second sub air bag structure 122*b* in the air bag structure 120 may be disposed along the short sides SE of the base 110 instead, and through the foregoing operation manner, the feet or head of the patient may be lifted as well, and which should not be construed as limitations to the disclosure. If the patient's head is lifted up, assisted feeding may thereby be performed to the patient. In addition, in other embodiments, a number of the sub air bag structures 122 included in the air bag structure 120 may be greater than two, the sub air bag structures may be disposed on different regions of the base 110, and fluid may be injected into the sub air bag structures 122 located on different regions together with the fluid driving device 130. The sub air bag structures 122 on different regions are expanded and thereby expands, and the sub air bag structures 122 not being injected is flat-shaped, so that the air bag structure 120 on the base 110 exhibits an uneven thickness distribution, and that the posture of the patient may be more accurately adjusted.

In this embodiment, the controller G may include a timing function, so that the medical professional may set a time condition for the controller G. The controller G may generate a control signal according to the time condition, so as to control the fluid driving device 130 to inject fluid into or extract fluid from a selected sub air bag structure 120 at different times, and the patient's posture may thereby be regularly adjusted.

In this embodiment, the amount of fluid in the base 110 or in the sub air bag structure 120 is controlled through the control valves A1 and A3 connected to the fluid driving device 130 in the mattress structure 100. Fluid in the sub air bag structures 122 and the base 110 may be quickly discharged through the control valves A2 and A4 which are not connected to the fluid driving device 130 in the mattress structure 100, and the mattress structure 100 may thereby be stored quickly. Further, when cardiopulmonary resuscitation (CPR) is required to be performed to a patient, it means that the patient's condition is not good. In the embodiment, urgent needs from the patient may be satisfied as the mattress structure 100 may become flat through fast discharge through the control valve A4.

Figure 5:
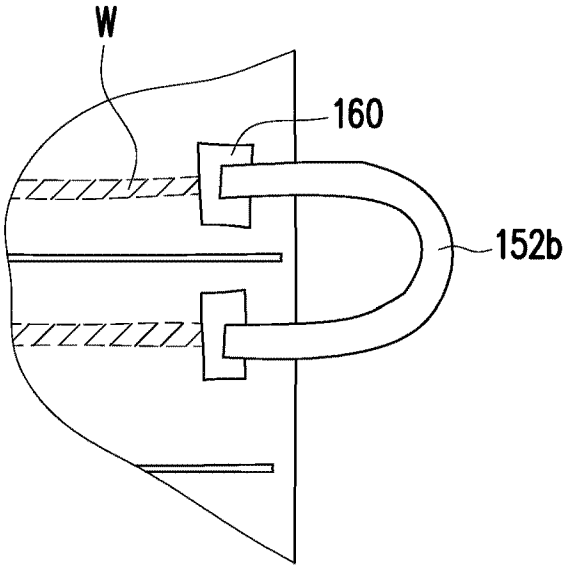
FIG. 5 is a schematic enlarged view of a region A in FIG. 4.
Figure 4:
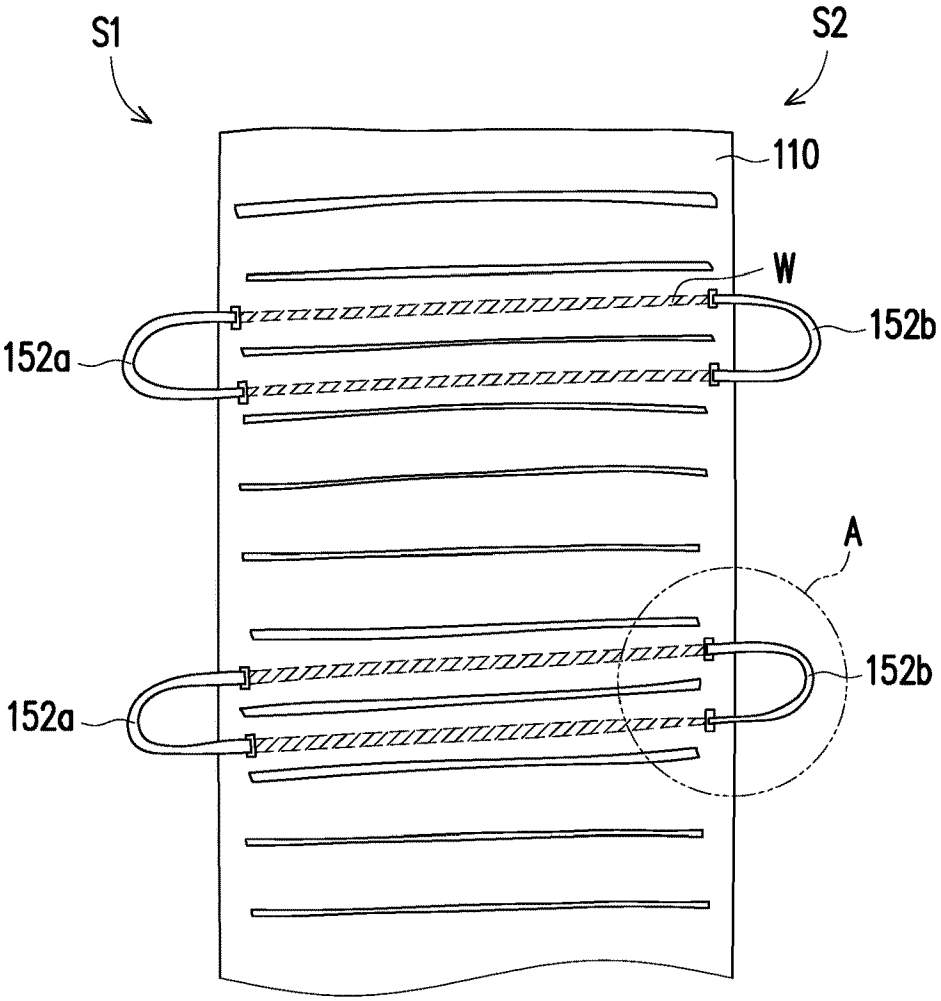
FIG. 4 is a schematic view of a bottom surface of the mattress structure of FIG. 1A
Figure 6:
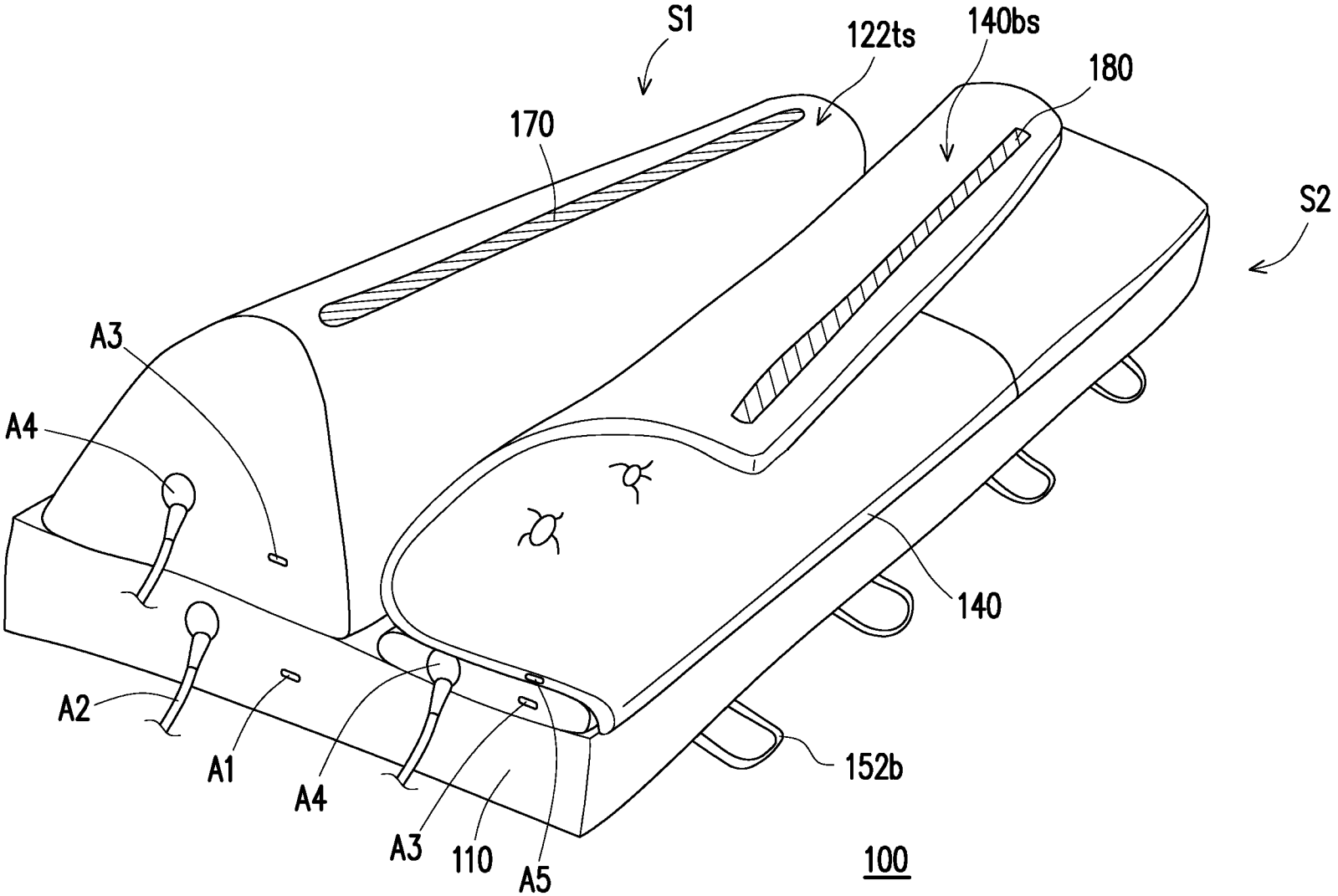
FIG. 6 is a schematic view of bonding of the mattress body structure and the air bag structure.

FIG. 4 is a schematic view of a bottom surface of the mattress structure of FIG. 1A FIG. 5 is a schematic enlarged view of a region A in FIG. 4. FIG. 6 is a schematic view of bonding of the mattress body structure and the air bag structure. For clarity of the drawings, the fluid driving device 130 and the controller G are omitted in FIG. 6.

With reference to FIG. 4 and FIG. 5, in this embodiment, the mattress structure 100 further includes a plurality of handle pairs 150. Each of the handle pairs 150 further includes two handle loops 152, the handle pairs 150 penetrate the base 110 so that the handle loops 152 are exposed. Handle loops 152*a* protrude from one side S1 of the base 110, and the handle loops 152*b* protrude from the other side S2 of the base 110. The handle pairs 150 are woven belts, for example. In this embodiment, the handle pairs 150 are welded to the base 110 through a welding manner, so that the two may be more firmly connected without being easily fractured. The oblique line portions in the drawings of FIG. 4 are welding lines W. Further, patch structures 160 are disposed at junctions between the handle pairs 150 and the base 110, so that the handle pairs 150 are prevented from being detached from the base 110. The patch structures 160 are, for example, square sheet structures, but are not limited thereto. Therefore, in the mattress structure 100 of this embodiment, the medical professional may directly apply a pulling force to the mattress structure 100 through the handle loops 152 on the handle pairs 150, so that the patient may be moved conveniently.

Alternatively, if the patient is in an unsafe environment and needs emergency evacuation, the medical professional may attach a pulling belt (not shown) on two handle loops 152 and indirectly applies a pulling force to the mattress structure 100 through the pulling belt and the two handle loops 152, so as to quickly drag the patient away from the environment.

With reference to FIG. 6, in this embodiment, the mattress structure 100 further includes first bonding structures 170 and second bonding structures 180. The first bonding structures 170 and the second bonding structures 180 refer to elements exhibiting an adhesion capability such as Velcro straps, but are not limited thereto. The first bonding structures 170 are disposed on top surfaces 122*ts* of the sub air bag structures 122. The second bonding structures 180 are disposed on a bottom surface 140*bs* of the mattress body structure 140. As regards the mattress body structure 140, the mattress body structure 140 may be detachably bonded onto the air bag structure 120 through the first bonding structures 170 and the second bonding structures 180, so that the medical professional may conveniently replace or clean the mattress body structure 140.

Figure 7:
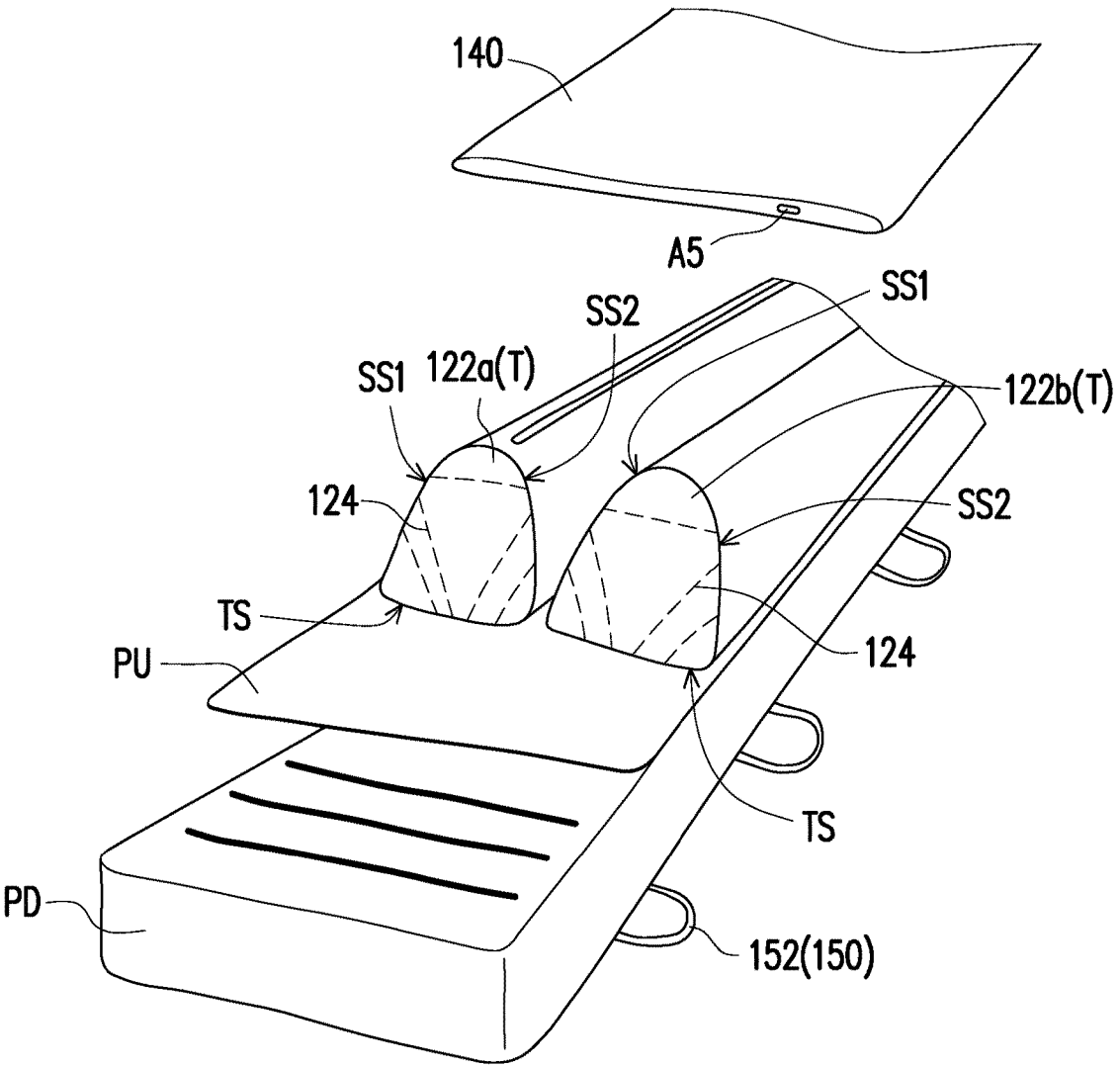
FIG. 7 is a schematic local exploded view of the mattress structure of the embodiments of FIG. 1A, FIG. 1B, FIG. 2A, and FIG. 2B.

FIG. 7 is a schematic local exploded view of the mattress structure of the embodiments of FIG. 1A, FIG. 1B, FIG. 2A, and FIG. 2B. A manufacturing method of the mattress structure 100 provided by the embodiments of the disclosure is briefly described in accompanying with FIG. 7.

With reference to FIG. 7, first, fluid is injected into the independent sub air bag structures 122 in the air bag structure 120, so the sub air bag structures 122 expand, and each of the sub air bag structures 122 exhibits the triangular prism-like structure T (also called as a backrest).

Next, the supporting structures 124 are welded to the triangular prism-like structures T through a welding manner, for example. For instance, at least one of the supporting structures 124 is connected to the two side surfaces SS1 and SS2, parts of the rest of the supporting structures 124 are connected to one side surface SS1 of the two side surfaces SS1 and SS2 and the bottom surface TS, and other parts of the rest of the supporting structures are connected to one side surface SS2 of the two side surfaces SS1 and SS2 and the bottom surface TS.

Next, the sub air bag structures 122 provided with the supporting structures 124 are connected to a first portion PU of the base 110 through, for example, a welding manner. The first portion PU of the base 110 may be treated as a bottom material of the backrest.

Next, the first portion PU of the base 110 is connected to a second portion PD of the base 110 through, for example, a welding manner.

Finally, the control valve A1 of the base 110 is connected to the fluid driving device 130 through the transportation pipeline C1, the control valve A3 of each of the sub air bag structures 122 is connected to the fluid driving device 130 (not shown) through the transportation pipeline C2. The mattress body structure 140 is disposed on the air bag structure 120. So far, manufacturing of the mattress structure 100 provided by the embodiments of the disclosure is substantially completed.

In view of the foregoing, the mattress structure in the embodiments of the disclosure features one or more advantages provided as follows:

1. Fluid is selectively injected into the corresponding sub air bag structure through the fluid driving device in the mattress structure, so the corresponding sub air bag structure expands, and that the posture of the patient lying thereon may be adjusted through the expanded sub air bag structure. For instance, fluid is injected into the sub air bag structures disposed on different positions, the air bag structure on the base may thereby exhibit a thickness distribution, so that the patient may be assisted in performing different postures such as turning over, head-lifting, or feet-lifting.

2. When the corresponding sub air bag structure expands, the supporting structures disposed in the sub air bag structure may provide the two opposite surfaces of the sub air bag structure with a favorable shape fixing force to resist the outward fluid pressure, so that the expanded sub air bag structure expands in a certain shape and is significantly less susceptible to be excessively deformed, and the mattress structure may therefore feature favorable structural stability during operation.

3. In the mattress structure provided by the embodiments of the disclosure, tension is effectively shared through the supporting structures disposed in the sub air bag structures, and product reliability of the mattress structure is thereby enhanced.

4. In the mattress structure provided by the embodiments of the disclosure, the plurality of handle pairs are included, and the medical professional may conveniently move the patient through theses handle pairs.

5. In the mattress structure provided by the embodiments of the disclosure, the mattress body structure may be detachably bonded onto the air bag structure through the plurality of the first and the second bonding structures, so that the medical professional may conveniently replace the mattress body structure.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A mattress structure, comprising:

a base;

an air bag structure, disposed on the base, the air bag structure comprising a plurality of independent sub air bag structures, a plurality of supporting structures disposed in each of the sub air bag structures;

a fluid driving device, connected to the sub air bag structures so as to inject fluid into the sub air bag structures selectively; and a plurality handle pairs, welded to the base, each of the handle pairs further comprising two handle loops that are integral, the handle pairs penetrating two opposite sides of the base so that the handle loops protrude from the two opposite sides of the base, wherein, when the fluid driving device injects the fluid into at least one of the sub air bag structures so as to make at least one of the sub air bag structures expand, in the corresponding expanded sub air bag structure, each of the supporting structures is connected to two opposite surfaces of the sub air bag structure.

2. The mattress structure as claimed in claim 1, wherein when the sub air bag structure expands, the sub air bag structure exhibits a triangular prism-like structure, and the triangular prism-like structure has a bottom surface and two side surfaces connected to the bottom surface, wherein, the supporting structures comprise a first supporting structure and a plurality of second supporting structures, the first supporting structure is connected to the two side surfaces, parts of the second supporting structures are connected to one of the two side surfaces and the bottom surface, and other parts of the second supporting structures are connected to the other one of the two side surfaces and the bottom surface.

3. The mattress structure as claimed in claim 2, wherein a width of the triangular prism-like structure gradually decreases from one side adjacent to the base towards the other side of away from the base.

4. The mattress structure as claimed in claim 2, wherein an included angle between an extended surface of the bottom surface of the triangular prism-like structure and an extended surface of anyone of the two side surfaces is less than or equal to 45 degrees.

5. The mattress structure as claimed in claim 1, wherein the sub air bag structures comprise a first sub air bag structure and a second sub air bag structure, and the fluid driving device injects fluid to or extracts fluid from the first sub air bag structure and the second sub air bag structure selectively, so that a thickness difference is provided between the first sub air bag structure and the second sub air bag structure.

6. The mattress structure as claimed in claim 5, wherein a structure of the base is a rectangular structure, and the first sub air bag structure and the second sub air bag structure are disposed along long sides of the rectangular structure.

7. The mattress structure as claimed in claim 1, wherein the base further comprises a first control valve, and the fluid driving device is connected to the base through the first control valve, so as to selectively inject fluid into the base or extract fluid from the base.

8. The mattress structure as claimed in claim 7, wherein the base further comprises a second control valve different from the first control valve, wherein the first control valve is a bidirectional control valve, and the second control valve is a unidirectional control valve.

9. The mattress structure as claimed in claim 1, wherein each of the sub air bag structures further comprises a third control valve, and the fluid driving device is connected to the sub air bag structures through the third control valves.

10. The mattress structure as claimed in claim 9, wherein each of the sub air bag structures further comprises a fourth control valve different from the third control valve, wherein the third control valve is a bidirectional control valve, and the fourth control valve is a unidirectional control valve.

11. The mattress structure as claimed in claim 1, further comprising a plurality of first bonding structures, a plurality of second bonding structures, and a mattress body structure, wherein, the first bonding structures are disposed on top surfaces of the sub air bag structures, and the second bonding structures are disposed on a bottom surface of the mattress body structure, wherein the mattress body structure provides bonding through the first bonding structures and the second bonding structures, so that the mattress body structure is detachably bonded to the air bag structure.

12. The mattress structure as claimed in claim 1, wherein patch structures are disposed at junctions between the handle loops and the base.

* * * * *